US006363633B1

(12) United States Patent
Holzer et al.

(10) Patent No.: US 6,363,633 B1
(45) Date of Patent: Apr. 2, 2002

(54) EXCAVATING IMPLEMENT

(76) Inventors: Diane Holzer; Richard A. Holzer, both of 2211 Adler, Lewiston, ID (US) 83501

( * ) Notice: Subject to any disclaimer, the term of this patent is extended or adjusted under 35 U.S.C. 154(b) by 0 days.

(21) Appl. No.: 09/646,549

(22) PCT Filed: Dec. 23, 1998

(86) PCT No.: PCT/US98/27653

§ 371 Date: Sep. 18, 2000

§ 102(e) Date: Sep. 18, 2000

(87) PCT Pub. No.: WO00/39407

PCT Pub. Date: Jul. 6, 2000

(51) Int. Cl.[7] ..... E02F 3/36
(52) U.S. Cl. ..... 37/446
(58) Field of Search ..... 37/446, 443, 444, 37/449, 450; 414/694; 172/772, 772.5; D15/32

(56) References Cited

U.S. PATENT DOCUMENTS

| | | | |
|---|---|---|---|
| 508,685 | A | 11/1893 | Davy |
| 967,819 | A | 8/1910 | McKenzie |
| D144,738 | S | 5/1946 | Simmonds |
| 3,281,972 | A | 11/1966 | Kerestes |
| 3,426,459 | A | 2/1969 | Petersen |
| 3,497,973 | A | 3/1970 | Campbell |
| 3,706,388 | A | 12/1972 | Westendorf |
| 3,834,567 | A | 9/1974 | Miller |
| 4,271,614 | A | 6/1981 | Albrecht |
| 4,303,507 | A | 12/1981 | Smith |
| 4,449,309 | A | 5/1984 | Hemphill |
| D275,679 | S | 9/1984 | Bradshaw |
| 4,581,833 | A | 4/1986 | Zeravica |
| 5,413,181 | A | 5/1995 | Keigley |
| D361,772 | S | 8/1995 | Hulsey |
| 5,515,625 | A | 5/1996 | Keigley |
| 5,741,112 | A | 4/1998 | Lakin et al. |

*Primary Examiner*—Robert E. Pezzuto
(74) *Attorney, Agent, or Firm*—Wells, St. John, Roberts, Gregory & Matkin

(57) ABSTRACT

An excavating implement which includes a blade defining a top surface, an opposed bottom surface, a rear edge, a front edge, and opposed end surfaces. Primary cutting edges are spaced apart along the front edge, and secondary cutting edges positioned between the primary cutting edges. The secondary cutting edges are recessed relative to the primary cutting edges. The secondary and primary cutting edges intersect with the bottom surface. The blade also defines primary and secondary beveled surfaces forming acute angles with the bottom surface, and which extend angularly toward the rear edge from the respective primary and secondary cutting edges to intersect with the top surface.

60 Claims, 5 Drawing Sheets

EXCAVATING IMPLEMENT

TECHNICAL FIELD

The present invention relates to excavating implements and more particularly to implement blades.

BACKGROUND ART

Many conventional excavating devices are provided with buckets or blades (hereafter generally termed "bucket") for excavation purposes including digging, scraping, cleaning, and demolition. Such buckets are used to push, fracture and to shovel materials. The leading edge of a bucket is typically formed as a beveled or non-beveled straight edge that extends across the bucket bottom and is the first part of the bucket to engage the material being excavated. It is well understood that the leading edge is subjected to heavy wear and stress factors.

Some manufactures produce replacement edges for buckets with leading edges that are similar in configuration to the original, straight line bucket leading edge. Such attachments are intended to reduce wear on the original leading edges. This would be an advantage except for the fact that the straight cutting edges do not function efficiently for excavation and clean-up operations, nor will they operate efficiently to break up or shatter the materials being excavated. Further, straight line leading edges tend to ride over materials on a hard surface, thus leaving debris which slides under the blade.

Toothed attachments of various sorts have been produced which may be mounted to the top or bottom surfaces of conventional buckets or blades. They have teeth extending forwardly of the original edge. The forwardly projecting teeth are used for breaking up or shattering materials ahead of the bucket or blade. These attachments may improve operations but are use specific and often do not function effectively for clean-up operations for the same reasons stated above.

A long felt need has remained for a bucket with a leading edge that will function efficiently for numerous uses.

It is therefore one aspect of the present invention to provide an excavating implement that will function to reduce or substantially eliminate wear of a bucket leading edge, while providing structure that will improve excavation efficiency over a wide range of uses.

It is a further aspect of the present invention to provide such an excavating implement that may be adapted to fit numerous bucket configurations.

Still another aspect of the present invention is to provide such an excavating implement that will effectively reduce horsepower requirements and thereby improve overall operating efficiency of the implement power source.

Yet still another aspect of the present invention is to provide such an excavating implement that may be easily and quickly mounted to existing excavator buckets.

These and still further aspects and advantages of the present invention will become apparent from the following description which, taken with the appended drawings, disclose the best mode presently known to the Applicants for carrying out the invention.

BRIEF DESCRIPTION OF THE DRAWINGS

FIG. 12 is a view exemplifying operation of a preferred form of the present invention.

BEST MODES FOR CARRYING OUT THE INVENTION AND DISCLOSURE OF INVENTION

Figure 1:
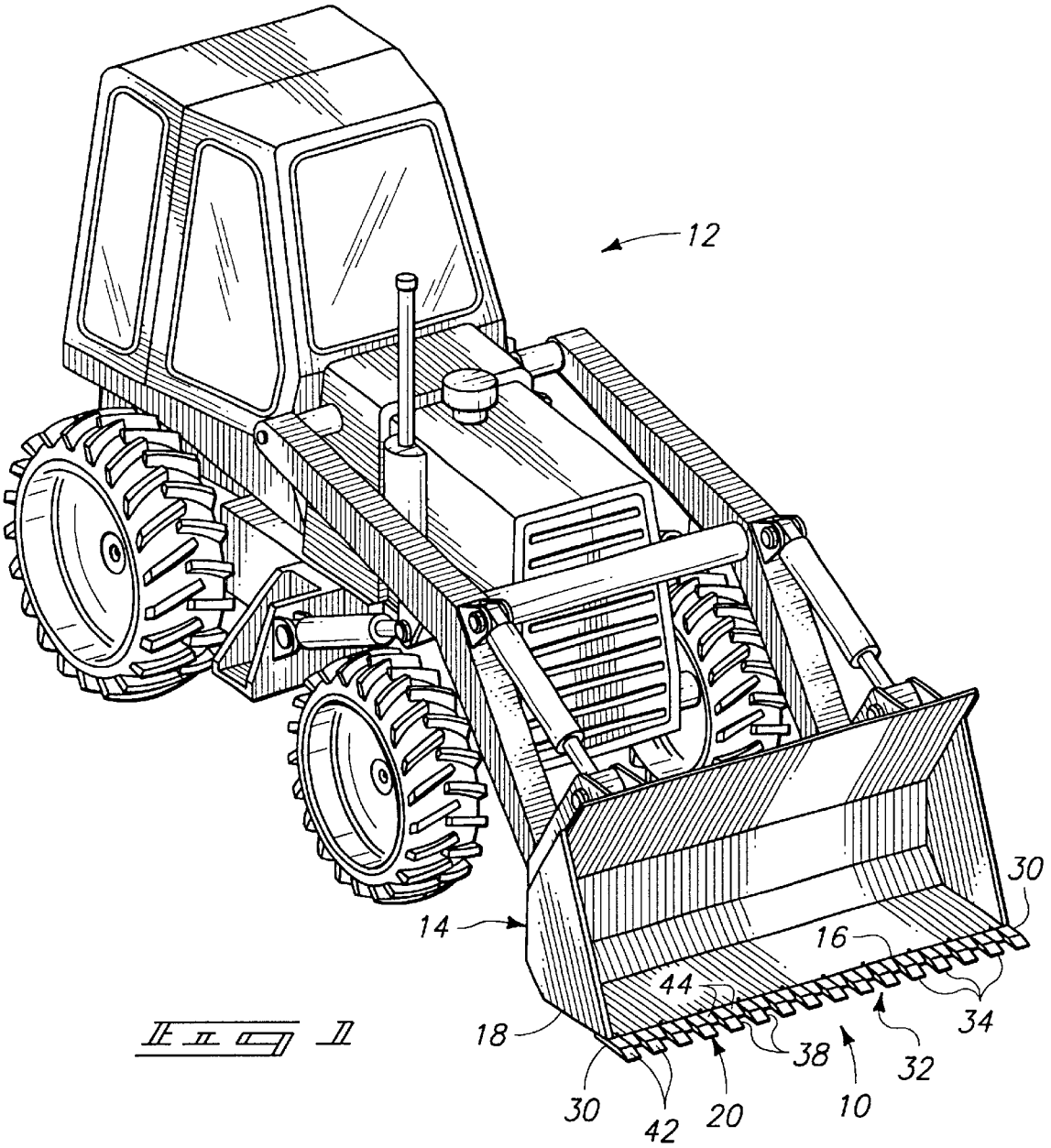
FIG. 1 is a perspective view of an excavator with a bucket and a preferred form of the present implement at the bucket leading edge.

Referring now in greater detail to the drawings, attention is first drawn to FIG. 1 where a preferred implement 10 is shown mounted to an excavator 12 with earth excavating bucket 14. In the illustrated example, the excavator 12 is a tractor and the bucket 14 is of a "front loader" style. It should be noted that the nature of the excavator 12 may vary, as may the configuration and usage of the bucket 14. For example, the present implement may be useful on "backhoe" excavators, graders, shovels, and other forms of excavators and excavator buckets.

Further, the term "bucket" as used herein is to be understood in a broad context to include not only the bucket form shown, but other configurations including but not limited to scraper blades, demolition blades, and shovel buckets, all of which have an earth engaging edge. Still further, it is to be understood that the present implement 10 may be supplied as a retrofit structure for existing buckets 14 or as an element in combination with a bucket assembly for distribution as original equipment.

The bucket 14 generally will include a leading edge 16 and most preferably a substantially flat bottom surface 18 adjacent the leading edge 16. These components and the remainder of the bucket structure may be produced using conventional construction techniques and materials well known in the excavation equipment industry.

Figure 9:
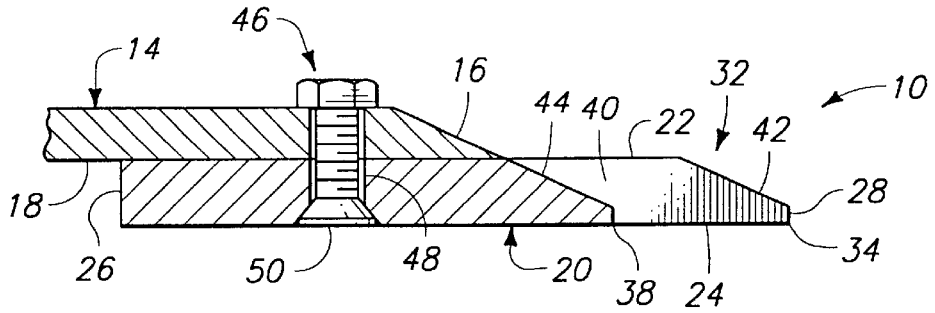
FIG. 9 is an enlarged sectional view showing a mounting configuration of the present implement bucket leading edge.

The present implement 10 in its most preferred form includes a monolithic blade 20 that is configured for flush engagement with the bottom surface 18 of the excavating bucket 12, substantially as shown by FIGS. 1, 9 and 12.

The blade 20 is most preferably formed as a casting from a high strength, wear abrasion resistant and ductile material that may be welded and machined. A preferred material meeting such qualifications is steel, and more specifically a grade of steel identified by the American Society for Testing and Materials as ASTM A148 Grade 150/125, with a chemical composition range including 0.33–0.37% carbon, 0.70–0.90% manganese, 0.55–0.65% chromium, 0.25–0.30 molybdenum, 0.35–0.45% silicon, 0.20–0.35% nickel, a maximum of 0.035% sulphur, and a maximum of 0.035% phosphorus. Heat treatment is also preferred, with the cast material being heated to approximately 1650–1700 degrees Fahrenheit and air-quenched. Minimum hardness is preferred to be at BHN (Brinell Hardness Number) 300.

It is also possible to manufacture the present blade from a solid bar or billet of similar steel using conventional machining processes. However, it is most preferable and economical that the blade be cast in the configuration as substantially shown in FIG. 2 to minimize or eliminate costly machining manufacturing processes.

Figure 5:
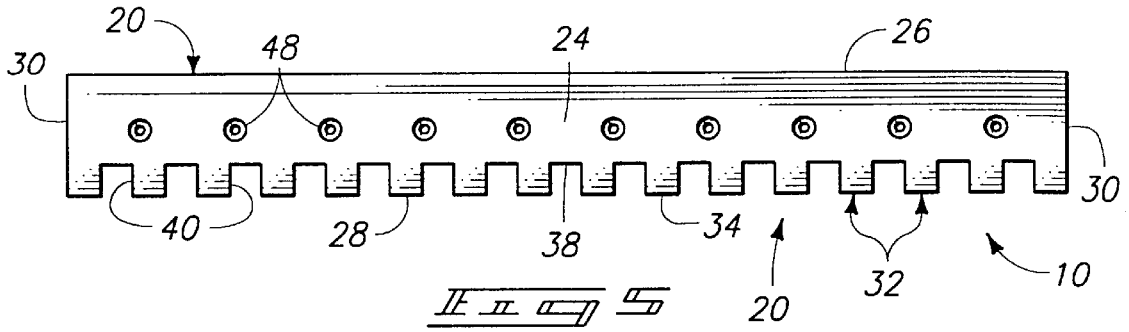
FIG. 5 is a bottom plan view of the excavating implement shown in FIG. 2.

In the preferred forms, the blade 20 defines a top surface 22 configured for flush engagement with the bottom surface 18 of the excavating bucket, substantially as shown by FIG. 9. The preferred blade 20 also defines a bottom surface 24, a rear edge 26, a front edge 28, and opposite ends 30 (FIGS. 2, 3 and 5).

The blade 20 also defines a plurality of primary cutting teeth 32 formed integrally therewith and which project in a given direction therefrom. It is most preferred that the teeth 32 be formed integrally with the blade 20, such that the entire implement 10 may be formed of a single casting.

Figure 2:
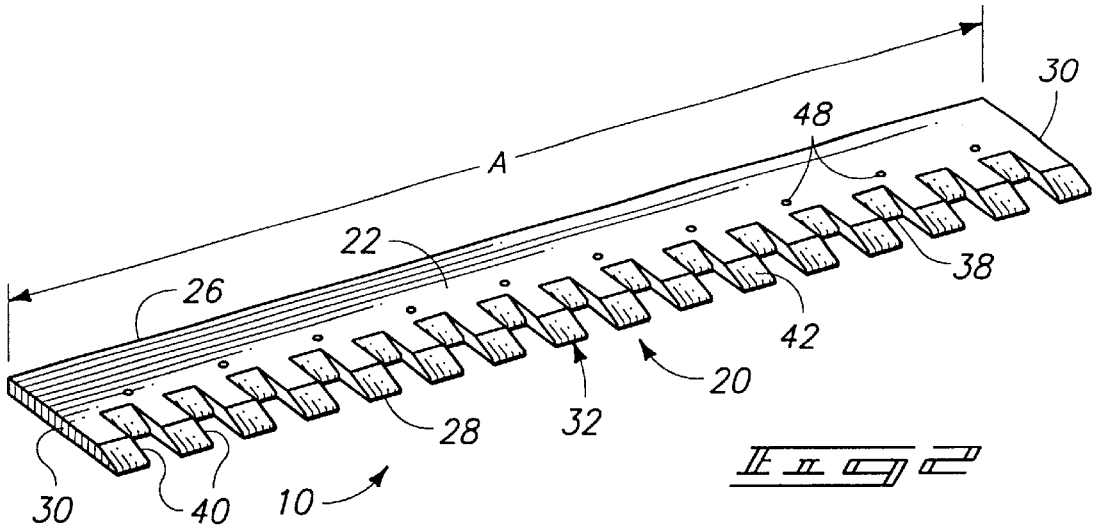
FIG. 2 is a perspective view of a preferred excavating implement for mounting as a retrofit to existing buckets.
Figure 3:
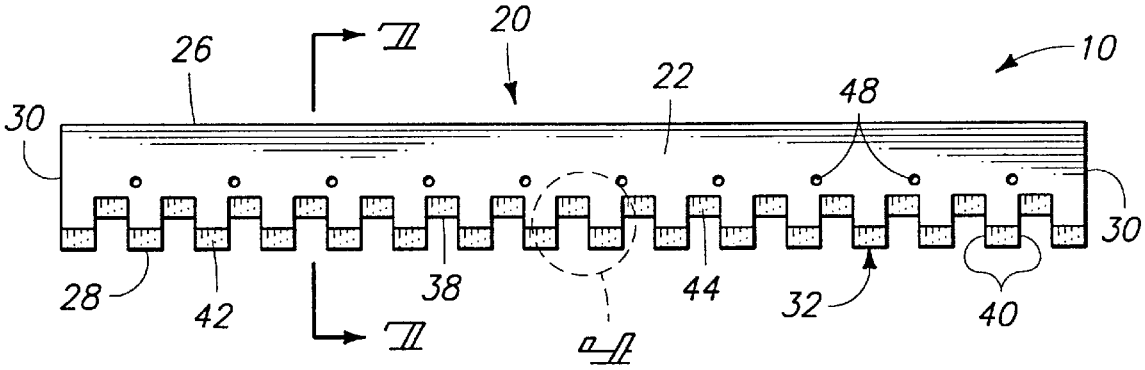
FIG. 3 is a top plan view of the excavating implement shown in FIG. 2.

The primary cutting teeth 32 are spaced apart along a blade length dimension which is identified by the letter A in FIG. 2. The teeth 32 include primary cutting edges 34 that are most preferably situated in an coaligned orientation as shown in FIG. 3. The length dimension may vary but it is preferably between about 0.61 meters to about 3.66 meters. Each of the primary cutting edges 34 has a width dimension C (FIG. 10) which is measured along the length dimension of the blade.

Secondary cutting edges 28 are also defined by the blade 20. The secondary edges 38 are individually interspersed between the primary cutting teeth 32 along the blade. At least some, and most preferably all of the secondary cutting edges 38 are recessed within the blade in relation to the primary cutting edges 34. It is also preferable that the secondary cutting edges 38 be substantially coaxially aligned as shown in FIG. 3, and parallel to the primary cutting edges.

Figure 8:
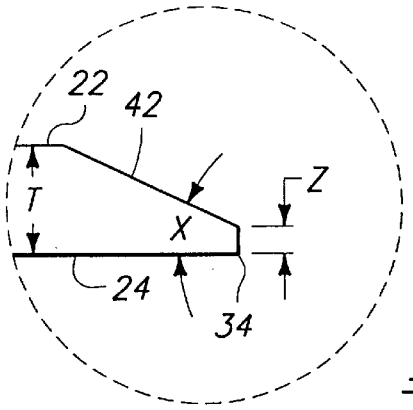
FIG. 8 is an enlarged fragment view of the area encircled by dashed lines and identified by the number 8 in FIG. 7.

As shown particularly in FIG. 8, the preferred primary cutting edge is not a knife edge, but is best provided as a narrow upright surface. A vertical dimension Z of approximately 6.35 millimeters has been found preferable for both primary and secondary cutting edges 34, 38. This arrangement enables extended use of the blade without significant wear along the edges. Scraping operations such as exemplified in FIG. 12 may also serve to sharpen or at least maintain the edges 34, 38 in substantially the configuration shown.

The cutting edges 34, 38 intersect with the bottom surface of the blade. The points of intersection between the edges and the bottom surface 24 lie along the plane of the bottom surface. The cutting edges 34, 38 are thus presented for engagement with materials as shown by FIG. 12, flush with a working surface. This arrangement facilitates clean-up and loading of loose material without the blade riding up and over the materials and thus leaving material behind.

Figure 10:
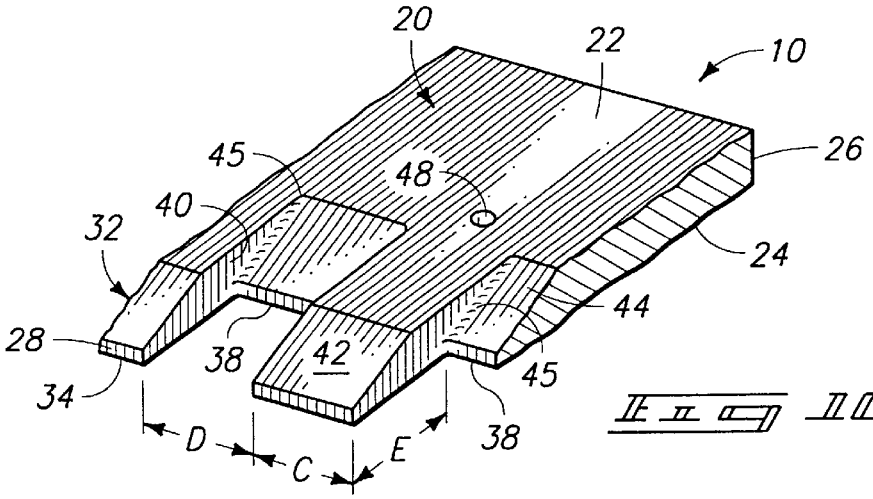
FIG. 10 is an enlarged fragmented perspective view showing a preferred cutting tooth configuration.
Figure 11:
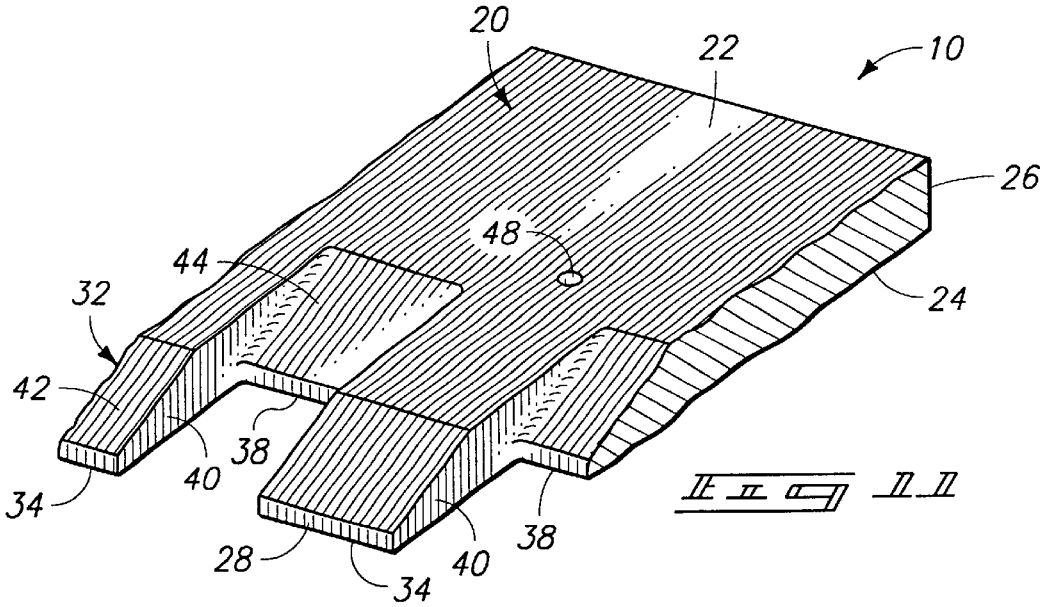
FIG. 11 is a view similar to the perspective view of FIG. 10 only showing a variation of scale and configuration for the present implement.
Figure 11:
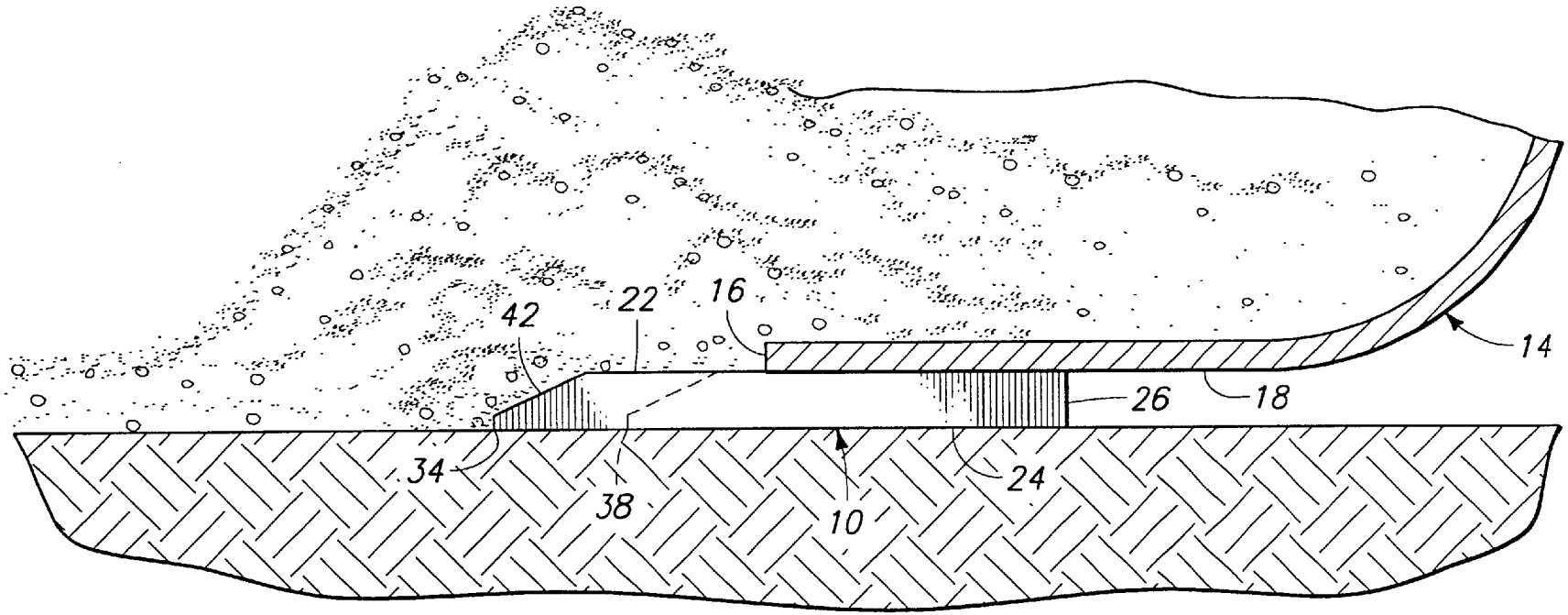

The secondary cutting edges 38 also include width dimensions, as identified in FIG. 10 at D. A preferred relationship exists between the width C of the primary cutting edges, and the width D of the secondary cutting edges. It is also preferred that the sum of the primary cutting edge widths C be greater than the one half of the length dimension A of the blade. The above relationships appear to contribute to the operational efficiency of the present implement.

Figure 4:
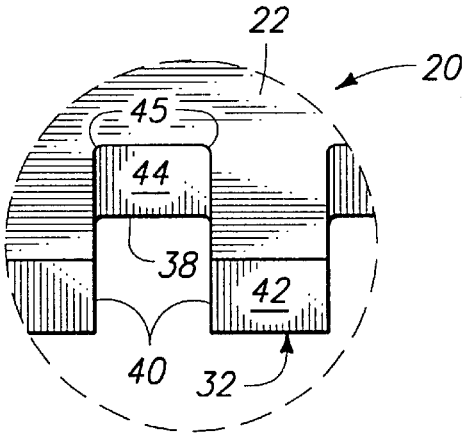
FIG. 4 is an enlarged fragmentary view of the area encircled by dashed lines and identified by the number 4 in FIG. 3.

Gullet side walls 40 are defined by the blade and join the primary and secondary cutting edges 34, 38. It is best that the gullet side walls 40 be substantially perpendicular to the respective cutting edges, and that they be joined to the secondary cutting edges by fillets 45 (FIG. 4).

Fillets 45 are formed in the blade and are located between the gullet side walls and the secondary cutting edges 34, 38. The fillets 45 are used to strengthen the teeth and avoid breakage during use. To this end, the preferred fillets 45 are formed with an approximate 1.6 millimeter radius.

Figure 6:
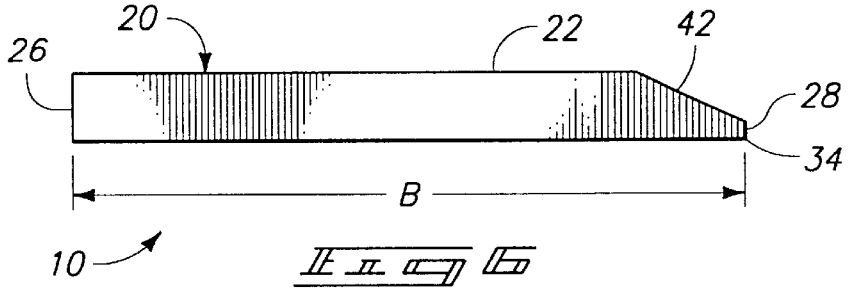
FIG. 6 is an enlarged end elevation view thereof.
Figure 7:
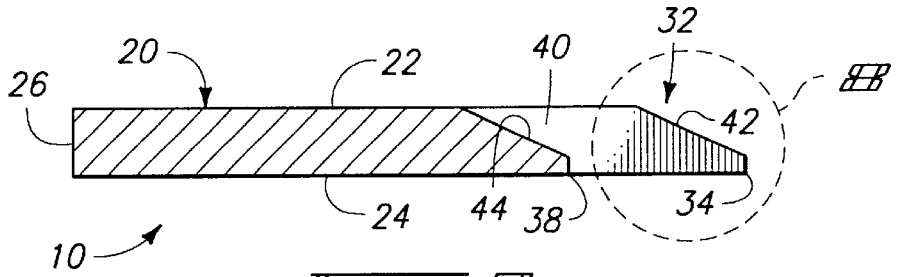
FIG. 7 is an enlarged sectional view taken substantially along line 7—7 in FIG. 3.

The second cutting edges 38 are recessed from the primary cutting edges 34 by a gullet depth dimension E (FIG. 10) that is less than about 50% of the blade width B (FIG. 6). Also, the gullet depth E is preferably less than about twice the width dimension of the primary cutting edges.

Another relationship that is believed to have some effect on the operation of the present invention is the thickness dimension T of the blade (measured between the top and bottom surfaces 22, 24) to the width of the cutting edges. More specifically, it is preferred that the thickness dimension T be about 20% to about 50% of the primary cutting edge width dimension C. Relative to the gullet depth dimension E, the thickness T is equal to about 25% to 40% of the gullet depth E. In preferred forms, the thickness dimension will be between about 1.27 centimeters to about 5.08 centimeters.

In the preferred forms of the invention, the blade defines primary and secondary beveled surfaces 42, 44 respectively that form acute angles with the bottom surface 24. The bevels 42, 44 extend angularly toward the rear edge 26 from the respective primary and secondary cutting edges 34, 38 and intersect with the top surface 22 along lines that substantially lie in a common plane with the top surface. It is preferable that the angles lie within a range of about 18° to about 27°, and further that the angles of the secondary beveled surfaces are approximately equal to the angles of the primary beveled surfaces.

A blade-to-bucket mounting attachment 46 may be provided to rigidly secure the blade to the excavating bucket with the primary and secondary cutting edges spaced forwardly of the leading edge. This condition is shown in FIG. 9 for one bucket configuration in which the leading edge 16 is beveled, and in another configuration in FIG. 12 wherein the bucket shown includes a flat leading edge. In either case, the mounting attachment is provided in such spatial relation relative to the primary and secondary cutting edges that both edges will be situated forwardly of the associated leading bucket edge. Also in preferred forms, the attachment may be comprised of appropriately formed mounting holes 48 formed in the blade at the preselected locations, and conventional mounting fasteners 50. It is also possible that the blade could be welded to the bucket, or otherwise attached by known, conventional fastening techniques.

Prior to operation of the present invention, blade selection is made according to the form and size of bucket to which the blade is to be attached. The blade 20 may be manufactured in numerous sizes to fit various forms of buckets and bucket sizes. In fact it is possible that the blade may be provided in several sections, which are joined endwise, to span a particularly wide bucket.

If the present blade is to be provided in combination with a bucket, this selection process and the mounting steps described below may take place at a common manufacturing site. If the blade is provided as a retrofit for attachment to buckets, the mounting process may occur wherever the bucket is located.

Installation of the selected blade 20 on a selected bucket 14 is accomplished using the mounting fasteners 50 or another attachment technique. Care is taken to assure that the blade 20 is secured to the bucket 14 with the top surface 22 in flush engagement with the bottom surface 18 of the bucket. Thus the top surface 22 becomes coplanar with the bucket bottom, at least along the bucket leading edge 16. This also makes the bottom surface 24 parallel with the bucket bottom, since the surface 24 is preferably parallel to the top surface 22. FIG. 12 illustrates this relationship.

Care is also taken during mounting of the blade that the primary and secondary cutting edges 34, 38 are situated forwardly of the bucket leading edge. Where the bucket has an inclined leading edge (FIG. 9) it is preferred that the secondary inclined surfaces 44 be positioned so they lead directly to or are substantially coplanar with that same surface. FIG. 12 shows the relationship of a blunt leading edge 16 with the blade, in which both primary and secondary cutting edges of the blade are forward of the bucket leading edge.

Once the blade 20 is properly secured to the bucket, utilization of same may begin. In clean-up operations or where material is to be removed from a support surface, the bucket is positioned such that the blade bottom rests in flush engagement with the support surface. The bucket and blade are then moved forwardly into the material to be removed. Since the flat bottom surface 24 is consistent across the blade, the blade will not ride over the material and the clean-up operation may be completed with little or no materials being left behind the bucket. Instead, the materials will be scooped into the bucket. This significantly reduces or eliminates the need for further clean-up of materials. This represents a significant advantage over prior blade attachments with open spaces between teeth where materials can accumulate and be left on the support surface. In digging or demolition work, the primary cutting edges first engage and penetrate the materials being excavated, breaking up or shattering materials engaged by the blade, followed by the integral secondary cutting edges which continue the excavating work. The geometric relationships exemplified above significantly and positively affect the excavation effort, increasing the overall work efficiency of the present blade and bucket combination over the conventional bucket forms in which the leading edge is straight and blunt or beveled.

Testing of the present blade configuration has indicated significantly improved clean-up and excavation efficiency over the same buckets using conventional straight leading edges. Overall time for producing the same results has been significantly reduced, which results in lower power requirements and increased fuel efficiency for the drive implement. Further, the same blade structure can be used effectively for clean-up and for excavating operations. This is another distinct advantage over specialty blade attachments that are intended to be use specific. Additionally, those skilled in the art have expressed surprise regarding the performance improvement noted in excavating devices utilizing the present invention. As the present blade wears, the tendency has been found for the primary and secondary edges to become sharper (due to a reduction of the dimension Z along the cutting edges) and efficiency improves even further. Eventually, of course, the blade will wear out and at such time a fresh blade may be obtained to replace the worn blade, leaving the bucket relatively wear-free.

What is claimed is:

1. In an earth excavating bucket having a bottom wall with a beveled surface leading to a leading edge and a substantially flat bottom surface adjacent the leading edge, an excavating implement, comprising:

a blade defining a top surface configured for flush engagement with the bottom surface of the excavating bucket, a bottom surface, a rear edge, a front edge, and opposite ends;

primary cutting edges defined by the blade and spaced apart along the front edge;

secondary cutting edges defined by the blade and situated between the primary cutting edges;

wherein the secondary cutting edges are recessed with respect to the primary cutting edges;

wherein the blade defines primary and secondary beveled surfaces forming acute angles with the bottom surface, and which extend angularly toward the rear edge from the respective primary and secondary cutting edges and intersect with the top surface;

a blade-to-bucket mounting attachment configured to rigidly secure the blade to the excavating bucket with the primary and secondary cutting edges spaced forwardly of the leading edge and with the secondary beveled surfaces forming a substantially continuous surface with the beveled surface of the excavating bucket bottom wall; and the bottom surface being substantially planar and intersecting the primary and secondary cutting edges.

2. The excavating implement of claim 1 wherein:

the primary cutting edges are formed integrally with the blade and are spaced apart along a length dimension of the blade and projecting in a given direction therefrom;

the primary cutting edges each has a width dimension which is measured along the length dimension of the blade;

the secondary cutting edges are individually interspersed between the primary cutting edges along the blade; and wherein at least some of the secondary cutting edges are recessed relative to the primary cutting edges by a distance which is less than about twice the width dimension of the primary cutting edges.

3. The excavating implement of claim 1, wherein the primary cutting edges each include a cutting edge width dimension measured along the blade length dimension;

the blade includes a thickness dimension measured between the top and bottom surfaces; and wherein the thickness dimension of the blade is about 20% to about 50% of the primary cutting edge width dimension.

4. The excavating implement of claim 1, wherein:

the primary beveled surfaces are located forwardly of the secondary cutting edges.

5. The excavating implement of claim 1, wherein:

the rear edge is spaced from the primary cutting edges and which define a blade width dimension;

the secondary cutting edges are recessed relative to the primary cutting edges by a gullet depth dimension that is less than about 50% of the blade width dimension.

6. The excavating implement of claim 1, wherein the individual primary cutting edges each include a width dimension and wherein the secondary cutting edges are spaced toward the rear edge from the primary cutting edges by distances at least approximately equal to said width dimension of the primary cutting edges.

7. The excavating implement of claim 1, wherein said blade includes a blade length dimension spanning the opposed ends;

the individual primary cutting edges each have a width dimension and wherein the sum of the primary width dimensions of the primary cutting edges is greater than one half the length dimension of the blade spanning the opposed ends; and wherein the primary and secondary cutting edges are substantially coplanar with the bottom surface.

8. The excavating implement of claim 1, wherein the respective primary and secondary cutting edges are substantially coplanar with the bottom surface and are substantially aligned with each other;

and wherein gullet side walls are defined by the blade and join the primary and secondary cutting edges; and wherein fillets are formed in the blade and are located between the gullet side walls and the secondary cutting edges.

9. The excavating implement of claim 1, wherein the blade is monolithic and has a length dimension which is defined between the ends;

the primary cutting edges are integral with the blade and spaced apart along the front edge, each primary cutting edge having a given width dimension and wherein the sum of the width dimensions of the primary cutting edges is greater than half the length dimension of the monolithic blade;

the secondary cutting edges are integral with the monolithic blade and inwardly located between the primary cutting edges, and wherein the secondary edges are substantially parallel to the primary cutting edges and recessed relative to the primary cutting edges; and the respective primary and secondary cutting edges being substantially coplanar along the bottom surface.

10. The excavating implement of claim 1, wherein said blade includes a thickness dimension between the top and bottom surfaces, a length dimension between the opposite ends, and a blade width dimension between the front and rear edges;

each of said primary and secondary cutting edges include an individual edge width dimension measured along the length of the blade;

the thickness dimension of the blade is less than about half the individual edge width dimension;

the secondary cutting edges are spaced toward the rear edge from the primary cutting edges by a distance less than about half the blade width dimension; and the secondary and primary cutting edges are positioned along a plane that is coplanar with the bottom surface.

11. The excavating implement of claim 1, wherein the secondary and primary cutting edges intersect with the bottom surface; and the primary and secondary beveled surfaces form similar acute angles with the bottom surface.

12. The excavating implement as defined by claim 1, wherein the primary and secondary beveled surfaces are substantially parallel;

and further comprising gullet side walls joining the primary and secondary beveled surfaces; and fillets joining the secondary beveled surfaces and gullet side walls.

13. The excavating implement as defined by claim 1, wherein the top and bottom surfaces are substantially planar and parallel.

14. The excavating implement as defined by claim 1, wherein the bottom surface is substantially flat and continuous across the blade.

15. The excavating implement as defined by claim 1, wherein the blade has a length dimension from about 0.61 meters to about 3.66 meters.

16. The excavating implement as defined by claim 1, wherein the blade includes a thickness dimension of about 1.27 centimeters to about 5.08 centimeters.

17. The excavating implement as defined by claim 1, wherein the blade, primary cutting edges, secondary cutting edges, primary bevel surfaces and secondary bevel surfaces are formed as a casting.

18. The excavating implement as defined by claim 1, wherein the blade is formed as a casting.

19. The excavating implement as defined by claim 1, wherein the primary and secondary cutting edges are substantially parallel.

20. The excavating implement as defined by claim 1, wherein the primary and secondary cutting edges are substantially parallel to the rear edge.

21. The excavating implement as defined by claim 1, wherein the primary cutting edges are aligned along the blade.

22. The excavating implement as defined by claim 1, wherein the secondary cutting edges are aligned along the blade.

23. The excavating implement as defined by claim 1, wherein the primary cutting edges are aligned along the blade and the secondary cutting edges are aligned along the blade and offset toward the rear from the primary cutting edges.

24. The excavating implement as defined by claim 1, wherein the individual primary and secondary cutting edges each have a width dimension as measured along the front edge, and wherein the width dimension of each primary cutting edge is substantially equal to the width dimension of each secondary cutting edge; and further comprising substantially parallel gullet side walls joining the primary and secondary cutting edges.

25. The excavating implement as defined by claim 1, wherein the individual primary cutting edges each have a primary edge width dimension, and wherein each secondary cutting edge is recessed from an adjacent width dimension, and wherein each secondary cutting edge is recessed from an adjacent primary cutting edge by a distance which is greater than the primary edge width dimension; and further comprising substantially parallel gullet side walls extending from the primary cutting edges to join at fillets with the secondary cutting edges.

26. The excavating implement as defined by claim 1, wherein the individual primary cutting edges have a primary cutting edge width dimension, and wherein the secondary cutting edges are recessed from the primary cutting edges by a distance which is equal to about the primary cutting edge width and is not greater than about twice the primary cutting edge width dimension; and further comprising gullet walls that are substantially perpendicular to the top and bottom surfaces of the blade and join the primary and secondary cutting surfaces.

27. The excavating as defined by claim 1, wherein:

the blade has a blade length dimension;

the individual primary cutting edges each have a primary cutting edge width dimension; and wherein the sum of the primary cutting edge width dimensions is greater than half the blade length dimension; and wherein at least some of the secondary cutting edges are formed along a line that is recessed relative to the primary cutting edges by a distance that is less than about twice the width dimension of the primary cutting edges.

28. The excavating implement as defined by claim 1, wherein the acute angles lie within a range of about 18° to about 27°.

29. The excavating implement as defined by claim 1, wherein the acute angles are substantially equal and wherein the primary and secondary cutting edges are separated by equal distances.

30. The excavating implement as defined by claim 1, and further comprising mounting apertures formed through the blade between the top and bottom surfaces, and wherein the apertures are disposed between the secondary cutting edges and the rear edge.

31. The excavating implement as defined by claim 1, and further comprising gullet side walls defined by the blade and which join with the primary and secondary cutting edges and that are substantially perpendicular to the primary and secondary cutting edges.

32. The excavating implement as defined by claim 1, and further comprising substantially parallel gullet side walls which are formed in the blade and which join with the primary and secondary cutting edges.

33. The excavating implement as defined by claim 1, and further comprising gullet side walls which are formed in the blade and which are substantially normal relative to the top and bottom surfaces.

34. The excavating implement as defined by claim 1, and further comprising substantially parallel gullet side walls which are formed in the blade and which are substantially normal to the top and bottom surfaces, and wherein the gullet sidewalls join the primary and secondary cutting edges.

35. The excavating implement as defined by claim 1, and further comprising substantially parallel gullet side walls which are formed in the blade and which join with the primary and secondary cutting edges; and wherein the secondary cutting edges and respective secondary bevels are joined by fillets formed along the gullet side walls.

36. An excavating implement for attachment to an excavating bucket, comprising:

a blade defining a top surface configured for flush engagement with the excavating bucket, a bottom surface, a rear edge, a front edge, and opposite ends;

primary cutting edges formed integrally with and defined by the blade and spaced apart along the front edge;

secondary cutting edges formed integrally with the blade substantially parallel to the primary cutting edges and situated between the primary cutting edges;

wherein the secondary cutting edges are recessed with respect to the primary cutting edges;

wherein the blade defines primary and secondary beveled surfaces forming acute angles with the bottom surface, and which extend angularly toward the rear edge from the respective primary and secondary cutting edges and intersect with the top surface;

gullet side walls that are substantially parallel to one another and join the primary and secondary cutting edges;

a blade-to-bucket mounting attachment configured to rigidly secure th eblad to the excavating bucket; and the bottom surface being substantially planar and intersecting the primary and secondary cutting edges.

37. The excavating implement of claim 36 wherein:

the primary cutting edges are spaced apart along a length dimension of the blade and projecting in a given direction therefrom;

the primary cutting edges each has a width dimension which is measured along the length dimension of the blade;

the secondary cutting edges are individually interspersed between the primary cutting edges along the blade; and wherein at least some of the secondary cutting edges are recessed relative to the primary cutting edges by a distance which is less than about twice the width dimension of the primary cutting edges.

38. The excavating implement of claim 36, wherein:

the primary cutting edges each include a cutting edge width dimension measured along the blade length dimension;

the blade includes a thickness dimension measured between the top and bottom surfaces; and wherein the thickness dimension of the blade is about 20% to about 50% of the primary cutting edge width dimension.

39. The excavating implement of claim 36, wherein:

the primary beveled surfaces are located forwardly of the secondary cutting edges.

40. The excavating implement of claim 36, wherein:

the rear edge is spaced from the primary cutting edges and which define a blade width dimension;

the secondary cutting edges are recessed relative to the primary cutting edges by a gullet depth dimension that is less than about 50% of the blade width dimension.

41. The excavating implement of claim 36, wherein:

the individual primary cutting edges each include a width dimension and wherein the secondary cutting edges are spaced toward the rear edge from the primary cutting edges by distances at least approximately equal to said width dimension of the primary cutting edges.

42. The excavating implement of claim 36, wherein the respective primary and secondary cutting edges are substantially coplanar with the bottom surface.

43. The excavating implement of claim 36, wherein said blade includes a thickness dimension between the top and bottom surfaces, a length dimension between the opposite ends, and a blade width dimension between the front and rear edges;

each of said primary and secondary cutting edges include an individual edge width dimension measured along the length of the blade;

the thickness dimension of the blade is less than about half the individual edge width dimension;

the secondary cutting edges are spaced toward the rear edge from the primary cutting edges by a distance less than about half the blade width dimension; and the secondary and primary cutting edges are positioned along a plane that is coplanar with the bottom surface.

44. The excavating implement of claim 36, wherein the secondary and primary cutting edges intersect with the bottom surface; and the primary and secondary beveled surfaces form similar acute angles with the bottom surface.

45. The excavating implement as defined by claim 36, wherein the top and bottom surfaces are substantially planar and parallel.

46. The excavating implement as defined by claim 36, wherein the bottom surface is substantially flat and continuous across the blade.

47. The excavating implement as defined by claim 36, wherein the blade has a length dimension from about 0.61 meters to about 3.66 meters.

48. The excavating implement as defined by claim 36, wherein the blade includes a thickness dimension of about 1.27 centimeters to about 5.08 centimeters.

49. The excavating implement as defined by claim 36, wherein the blade, primary cutting edges, secondary cutting edges, primary bevel surfaces and secondary bevel surfaces are formed as a casting.

50. The excavating implement as defined by claim 36, wherein the blade is formed as a casting.

51. The excavating implement as defined by claim 36, wherein the primary and secondary cutting edges are substantially parallel to the rear edge.

52. The excavating implement as defined by claim 36, wherein the primary cutting edges are aligned along the blade.

53. The excavating implement as defined by claim 36, wherein the secondary cutting edges are aligned along the blade.

54. The excavating implement as defined by claim 36, wherein the primary cutting edges are aligned along the blade and the secondary cutting edges are aligned along the blade and offset toward the rear edge from the primary cutting edges.

55. The excavating implement as defined by claim 36, wherein the gullet side walls extending from the primary cutting edges to join at fillets with the secondary cutting edges.

56. The excavating implement as defined by claim 36, wherein the gullet side walls intersect with and are substantially perpendicular to the top and bottom surfaces of the blade and join the primary and secondary cutting surfaces and the primary and secondary bevel surfaces.

57. The excavating implement as defined by claim 36, wherein the acute angles lie within a range of about 18° to about 27°.

58. The excavating implement as defined by claim 36, wherein the acute angles are substantially equal.

59. The excavating implement as defined by claim 36, and further comprising mounting apertures formed through the blade between the top and bottom surfaces, and wherein the apertures are disposed between the secondary cutting edges and the rear edge.

60. The excavating implement as defined by claim 36, wherein the gullet side walls are substantially perpendicular to the primary and secondary cutting edges and to the top and bottom surfaces.

* * * * *

UNITED STATES PATENT AND TRADEMARK OFFICE

CERTIFICATE OF CORRECTION

PATENT NO. : 6,363,633 B1
DATED : April 2, 2002
INVENTOR(S) : Diane Holzer et al.

It is certified that error appears in the above-identified patent and that said Letters Patent is hereby corrected as shown below:

Title page,
Item [57], ABSTRACT,
Line 1, insert -- is described -- after "implement"

Column 8,
Line 21, insert -- edge -- after "rear"
Line 33, insert -- primary cutting edge by a distance which is greater than the primary edge -- between "adjacent" and "width"

Signed and Sealed this

Twenty-ninth Day of October, 2002

*Attest:*

*Attesting Officer*

JAMES E. ROGAN
*Director of the United States Patent and Trademark Office*